US010244312B2

(12) United States Patent
Rousseau et al.

(10) Patent No.: US 10,244,312 B2
(45) Date of Patent: Mar. 26, 2019

(54) LOUDSPEAKERS

(71) Applicant: B & W GROUP LTD, Worthing, West Sussex (GB)

(72) Inventors: Martial Andre Robert Rousseau, Brighton (GB); Stuart Michael Nevill, Brighton (GB)

(73) Assignee: EVA Automation, Inc., Menlo Park, CA (US)

( * ) Notice: Subject to any disclaimer, the term of this patent is extended or adjusted under 35 U.S.C. 154(b) by 78 days.

(21) Appl. No.: 15/031,854

(22) PCT Filed: Oct. 23, 2014

(86) PCT No.: PCT/GB2014/053167

§ 371 (c)(1),
(2) Date: Apr. 25, 2016

(87) PCT Pub. No.: WO2015/059483

PCT Pub. Date: Apr. 30, 2015

(65) Prior Publication Data

US 2016/0269820 A1 Sep. 15, 2016

(30) Foreign Application Priority Data

Oct. 25, 2013 (GB) ..... 1318890.9

(51) Int. Cl.
*H04R 1/02* (2006.01)
*H04R 9/06* (2006.01)
(Continued)

(52) U.S. Cl.
CPC ..... *H04R 1/2873* (2013.01); *H04R 1/025* (2013.01); *H04R 9/06* (2013.01); *H04R 31/003* (2013.01); *H04R 2400/11* (2013.01)

(58) Field of Classification Search
CPC ..... H04R 1/2873; H04R 1/025; H04R 9/06
See application file for complete search history.

(56) References Cited

U.S. PATENT DOCUMENTS 4,797,935 A * 1/1989 Tanaka ..... H04R 1/2896 181/171
5,115,884 A * 5/1992 Falco ..... H04R 1/2819 181/151

(Continued)

FOREIGN PATENT DOCUMENTS

CN 201426173 Y 3/2010
EP 2728901 A1 5/2014

(Continued)

OTHER PUBLICATIONS

ScanSpeak D2008 This document is available at webpage available at: http://www.pinkfishmedia.net/forum/archive/index.php/t-35844.html (2007), 2 pages.

(Continued)

*Primary Examiner* — Simon King
(74) *Attorney, Agent, or Firm* — Steven Stupp

(57) ABSTRACT

A loudspeaker chassis assembly (2) comprises a loudspeaker chassis (4) and one or more mass damping elements (6), which dampen vibration of the chassis (4). The mass damping elements (6) may be directly attached to the chassis (4) and may be tuned to dampen one or more particular vibrational modes of the chassis (4).

22 Claims, 5 Drawing Sheets

(51) Int. Cl.
*H04R 1/28* (2006.01)
*H04R 31/00* (2006.01)

(56) References Cited

U.S. PATENT DOCUMENTS

| | | | | |
|---|---|---|---|---|
| 6,741,718 | B1 | 5/2004 | Brumitt et al. | |
| 8,135,164 | B2 | 3/2012 | Tanaka et al. | |
| 8,695,753 | B2 | 4/2014 | Goossens et al. | |
| 9,042,580 | B2 | 5/2015 | Gao et al. | |
| 2006/0037809 | A1* | 2/2006 | Fuller | F16F 1/361 181/207 |
| 2006/0045300 | A1* | 3/2006 | Sterns | H04R 1/02 381/345 |
| 2006/0239494 | A1* | 10/2006 | Kimura | H04R 9/06 381/386 |
| 2008/0159583 | A1 | 7/2008 | Tanaka et al. | |
| 2009/0185711 | A1* | 7/2009 | Shigeta | H04R 9/06 381/413 |
| 2009/0296978 | A1* | 12/2009 | Kamimura | H04R 9/10 381/412 |
| 2011/0135140 | A1* | 6/2011 | Tanabe | H04R 9/04 381/400 |
| 2012/0170794 | A1* | 7/2012 | Kim | H04R 9/043 381/413 |
| 2012/0308063 | A1* | 12/2012 | Martikainen | H04R 1/025 381/332 |
| 2012/0321122 | A1* | 12/2012 | Yamagishi | H04R 9/043 381/398 |
| 2013/0056296 | A1 | 3/2013 | Goossens et al. | |

FOREIGN PATENT DOCUMENTS

| | | | |
|---|---|---|---|
| FR | 2947689 | A1 | 1/2011 |
| GB | 577358 | A | 5/1946 |
| GB | 2445462 | A | 7/2008 |
| GB | 2478160 | A | 8/2011 |
| GB | 2480058 | A | 11/2011 |
| JP | 11055790 | A | 2/1999 |
| JP | 2001016685 | A | 1/2001 |
| JP | 2011139256 | A | 7/2011 |
| WO | 02/19765 | A1 | 3/2002 |
| WO | 2008082304 | A2 | 7/2008 |
| WO | 2011104659 | A2 | 9/2011 |

OTHER PUBLICATIONS

Search Report from related Patent Application No. GB1318890.9 dated Jun. 2, 2014.

Sound Research Laboratories Ltd "Noise Control in Industry" E. & F.N. Spon, Third Edition, (1990), 13 pages.

Written Opinion from PCT/GB2014/053167 dated Jan. 23, 2015.

Anonymous et al. "Oh bugger, blown SBL tweeter [Archive]—pink fish media" Retrieved from the Internet: URL: http://www.pinkfishmedia.net/forum/archive/index.php/t-106120.htm (retrieved on Dec. 18, 2014), XP055159529, Sep. 20, 2011, 2 pages.

Anonymous et al. "iCapture.dk—Services" Retrieved from the Internet: URL: http://www.web.archive.org/web/20121111171259/http://www.icapture.dk/services.html (retrieved on Dec. 19, 2014), XP055159617, Nov. 11, 2012, 7 pages.

* cited by examiner

LOUDSPEAKERS

This is the national phase under 35 U.S.C. § 371 of International Application No. PCT/GB2014/053167, filed on Oct. 23, 2014, which claims priority to and the benefit of GB Application No. 1318890.9, filed on Oct. 25, 2013, the entire contents of each of which are incorporated by reference.

TECHNICAL FIELD

The present invention relates to improvements in and relating to loudspeakers. More particularly, this invention concerns the improved damping of a loudspeaker chassis. The invention also concerns an improved loudspeaker chassis assembly, a loudspeaker drive unit comprising such a chassis assembly, a loudspeaker enclosure comprising such a loudspeaker drive unit, and a method of manufacturing such a chassis for a loudspeaker.

BACKGROUND OF THE INVENTION

A loudspeaker drive unit typically includes a diaphragm (also known as a cone), a chassis (also known as a basket or frame), a voice coil and a driver magnet. The diaphragm is typically attached to the chassis via a flexible suspension of some sort. For example, the diaphragm may be attached to the chassis by a two-part suspension comprising (i) a spider, typically a corrugated disk of flexible material which joins the centre of the diaphragm/voice-coil to the chassis and (ii) a surround, typically a ring of flexible material which joins the outer circumference of the diaphragm to the chassis. The voice coil is typically attached to the diaphragm so that in use an electrical current is applied to the voice coil generating an electromagnetic field which interacts with the magnetic field of the driver magnet thereby causing the voice coil and consequently the diaphragm to move.

In order to maintain sound quality in use, when the drive unit is installed in a loudspeaker enclosure such as a loudspeaker cabinet, it is desirable for the drive unit to produce controlled vibration in the diaphragm whilst minimising, or otherwise controlling, unwanted vibration in the other elements of the loudspeaker drive unit and enclosure. One way in which such undesirable vibrations in the enclosure can be reduced is to decouple the drive unit from the enclosure by means of a suspension system that allows for mounting of the chassis to the enclosure in such a way as to reduce the transmission of vibration in the chassis to the enclosure. The chassis can thus be decoupled from the enclosure. Such a solution suffers from the problem however that without a rigid connection between chassis and enclosure there tends to be greater vibration in the chassis than would otherwise be the case. This can result in a deterioration in the acoustic performance of the drive unit because, for example, the front ring of the chassis is more prone to vibrate undesirably and thus radiate unwanted sound colouring or otherwise distorting the acoustic response of the loudspeaker.

The present invention seeks to mitigate one or more of the above-mentioned problems. Alternatively or additionally, the present invention seeks to provide an improved loudspeaker drive unit. Alternatively or additionally, the present invention seeks to provide a loudspeaker drive unit which can provide improved acoustic performance.

SUMMARY OF THE INVENTION

According to a first aspect of the invention there is provided a loudspeaker chassis assembly comprising a loudspeaker chassis and one or more mass damping elements, wherein vibration of the chassis is damped by means of said one or more mass damping elements. The chassis assembly may be suitable for use as part of a loudspeaker drive unit. The chassis is arranged and configured so as to be suitable for supporting a loudspeaker diaphragm and for mounting in a loudspeaker enclosure to form a hi-fi loudspeaker unit. The diaphragm may for example comprise a cone shaped member.

A mass damping element may reduce vibration by dissipating energy. Thus, using mass damping elements to damp the vibration of the chassis allows the acoustic performance of the chassis to be improved. The present invention has thus recognised that damping of the chassis, particularly by using such mass damping elements, may improve performance of the drive unit. Such improvements are particularly, but not exclusively, of benefit in the case where the chassis assembly is part of a drive unit in a loudspeaker enclosure arranged such that the chassis is decoupled from the enclosure. Such an arrangement, without the use of the present invention, may reduce unwanted modes of vibration in the enclosure but increase unwanted modes of vibration in the chassis. With the use of the present invention it may be possible both to reduce unwanted modes of vibration in the enclosure without a significant increase in unwanted modes of vibration in the chassis of the drive unit, thereby providing an overall improvement in performance of the loudspeaker enclosure.

The or each mass damping element may include a mass element and a resilient portion. The resilient portion may be configured and arranged such that the mass element can move relative to the chassis. The resilient portion may be located between the mass element and the chassis. The mass element and the resilient portion may be integrally formed. The mass element may for example be defined by the resilient portion. The mass element and the resilient portion may be formed as separate components. The mass element may be attached to the resilient portion by an adhesive layer. The adhesive used to attach the mass element to the resilient portion may be chosen for its damping properties. The mass element may be moulded into the resilient portion. The mass element will typically have a density greater than the resilient portion. The density of the mass element, calculated as its total mass divided by its total volume, may be at least 2 $g/cm^3$, and preferably at least 5 $g/cm^3$.

The mass element and the resilient portion may be of a monolithic construction. The mass damping element and the chassis may be integrally formed. The mass damping element and the chassis may be formed by co-moulding them together. The mass damping element may be formed at least in part from a metal-loaded plastic material. For example, the mass element may be in the form of a single block of metal-loaded plastic material, for example, a tungsten loaded plastic. Such a material may be relatively dense and readily co-moulded with a resilient portion, and optionally the chassis. The mass damping element and the chassis may be formed as separate components.

The or each mass damping element may be directly attached to the chassis, for example so that the mass damping element directly dampens vibration of the chassis or a part thereof. Thus, it may be that there are no intervening components, or significant structure, between the chassis and the mass damping element. The mass damping element may be attached to the chassis by an adhesive layer. A mass damping element attached to the chassis by an adhesive layer may be said to be directly attached to the chassis. The adhesive used to attach the mass damping element to the chassis may be chosen for its damping properties. The resilient portion may be directly attached to the chassis. The resilient portion may be attached to the chassis by an adhesive layer.

The same adhesive may be used to attach the mass damping element to the chassis and to attach the mass element to the resilient portion. The adhesive may be a polyvinyl acetate (PVAc) adhesive. For example, the adhesive may be PVA glue. In use the chassis may be vibrated as a result of one or more of (i) the reaction force from the motor system, (ii) the suspension reaction force and (iii) the sound field inside a speaker cabinet.

A vibrational (or break-up) mode may be defined as a frequency at which the chassis stops moving as a rigid piston, that is with all the points on the chassis moving with the same phase. Thus, a vibrational mode may be characterised by a resonant frequency and a mode shape. A complex body such as a chassis may have more than one vibrational mode. Thus, the shape of the chassis at any particular frequency may be a combination of those vibrational modes. As the frequency at which the chassis is vibrated approaches a resonant frequency the shape approaches the mode shape of the corresponding vibrational mode.

Mass damping elements may reduce vibration in the chassis by dissipating kinetic energy. A mass damping element may be characterized by the mass of the mass element and the stiffness of the resilient portion. Thus, a mass damping element with a given mass and stiffness may improve the acoustic performance generally by dissipating kinetic energy in use. Alternatively or additionally, the mass of the mass damping element and the stiffness of the resilient portion may be chosen such that the mass damping element damps a specific vibrational mode. Such a mass damping element may be referred to as a tuned mass damping element. Altering the mass of the mass element and/or the stiffness of the resilient portion may thus enable a mass damping element to be tuned to a given frequency, when designing a mass damping-element for a given purpose. A mass damping element may be tuned by incorporating materials which have a high mechanical loss factor at the frequency of a given vibrational mode. For example, the mass damping-element may include materials which have a loss factor of at least 0.5 at a given vibrational mode (at operating temperature). Each mass damping element of the chassis assembly may be tuned to a specific vibrational mode. Thus, a vibrational mode of the chassis may be damped by the or each tuned mass damping element. A mass damping element tuned to a first mode may also attenuate vibration at a second mode. Some of the mass damping elements may be tuned to a particular vibrational mode and some not.

In the case of a chassis assembly including more than one tuned mass damping element, each mass damping element may be tuned to damp the same vibrational mode. All of the tuned mass damping elements may be tuned to have substantially the same frequency-dependent attenuation properties. Thus, a vibrational mode of the chassis may be damped by means of the tuned mass damping elements.

Alternatively, in the case of a chassis assembly including more than one tuned mass damping element, a first set of mass damping elements may be tuned to a first vibrational mode and a second set of mass damping elements may be tuned to a second vibrational mode. Further sets of tuned mass damping elements may be tuned to further vibrational modes. A set may include one or more tuned mass damping elements. Thus, more than one vibrational mode of the chassis may be damped by means of the tuned mass damping elements. Each significant vibrational mode of the chassis may be damped by means of the tuned mass damping elements.

Thus, the loudspeaker chassis assembly may include one or more tuned mass damping elements such that the one or more vibrational modes of the chassis are damped by said mass damping elements. The loudspeaker chassis assembly may include a tuned mass damping element, preferably chosen such that a vibrational mode of the chassis is damped by said mass damping element. The loudspeaker chassis assembly may include more than one tuned mass damping elements such that one or more vibrational modes of the chassis are damped by said mass damping elements.

Whether or not a mass damping element is deemed as being a tuned mass damping element, in the context of those aspects of the present invention which require such tuned mass damping elements, may (optionally) be judged in the following way. One may remove the mass damping element from the chassis and then measure the frequency response of both the mass damping element and of the chassis. The chassis will have response peaks at one or more frequencies where resonances occur whereas the mass damping element will have one or more frequencies at which the damping properties peak. If a resonant frequency, within the acoustic range of frequencies of relevance, of the chassis coincides with (within about 20%, and preferably within about 10% of the frequency) a frequency at which damping provided by the mass damping element peaks, then the mass damping element may be considered as a tuned element. It will be appreciated that a mass damping element may be deemed as a tuned mass damping element by means of alternative criteria. The chassis assembly may include primary tuned mass damping elements, tuned to dampen a primary mode of vibration of the chassis. The chassis assembly may include secondary tuned mass damping elements, tuned to dampen one or more secondary modes of vibration of the chassis (with the primary tuned mass damping elements attached). In such a case, the secondary tuned mass damping elements may need to be removed from the chassis to assess whether and how the primary tuned mass damping elements are tuned to the frequency response of the chassis.

The addition of the mass damping elements preferably reduces the response at a resonant frequency, within the acoustic range of frequencies of relevance, of the chassis by a factor of more than 2 (and preferably provides more than 5 dB of attenuation).

The chassis may include a chassis ring, preferably an outer ring. The chassis may include one or more support legs extending from the chassis ring, preferably extending radially inwardly from the ring. The chassis may include nine or more such support legs. The chassis may include a chassis base. The or each support leg may extend from the chassis ring to the chassis base. In use, the sound emitting surface of the diaphragm may be defined as forward-facing. In use the chassis ring may be located forward of the chassis base. The or each support leg and the chassis may be integrally formed. The chassis may have a diameter which is less than 500 mm, preferably less than 400 mm. The chassis may weigh between 50 g and 1000 g.

The mass element may be, or have the general form of, a block. The mass element may be, or have the general form of, a plate. The mass element may be formed, at least in part, from a metal. The mass element may be formed, at least in part, from steel. The mass element may be a steel plate. As mentioned above, the mass element may comprise a plastic material.

The mass element may be attached to the resilient portion by an adhesive layer. The adhesive used to attach the mass element to the resilient portion may be chosen for its damping properties.

The resilient portion may be, or have the general form of, a block, for example, an elastically deformable block. The mass damping element may for example comprise a metal plate and an elastically deformable block located between the chassis and the metal plate. The resilient portion preferably has a mechanical loss factor of at least 0.5 at the vibrational mode of interest (at operational temperature). The elastically deformable block may be a block of elastomeric material, for example an elastomeric polymer, rubber or rubber-like material. Preferably, the elastomeric material may be Butyl or Nitrile rubber, or SEBS (styrene ethylene butylene styrene) thermoplastic elastomer. Preferably, the mechanical loss factor at the first vibrational mode (at operating temperature) of the elastomeric material is greater than or equal to 0.5. The elastomeric material may have a mechanical loss factor of 1 at the first vibrational mode (at operating temperature). The resilient portion may be a rubber pad.

In the case where the chassis has a chassis ring, the elastically deformable block may be located directly between the mass element and the chassis ring. The elastically deformable block may be attached to the chassis ring by an adhesive layer. The or each mass damping element may be attached to the chassis ring. The or each mass damping element may be attached directly to the chassis ring. At least some of the benefits of the invention could be achieved by an embodiment utilising a single mass damping element. It is preferred however that the chassis assembly includes a plurality of mass damping elements attached to, and preferably directly attached to, the chassis. Using more than one (and preferably four or more) separate mass damping elements may allow more efficient use of the damping properties, and/or more efficient deployment of the material or means that provides such damping properties. The chassis assembly may include a plurality of mass damping elements circumferentially spaced around the chassis ring. The mass damping elements may be symmetrically arranged around the chassis ring. The mass damping elements may be a-symmetrically arranged around the chassis ring. Each mass damping element is conveniently in the form of a discrete element separate and spaced apart from other such mass damping elements, and preferably distinct from the rest of the chassis.

For any given vibrational mode, the chassis ring may have one or more nodes. For example, there may be vibration of the chassis at a given frequency the nodes being defined as those regions or points at which there is no vibration (or minimum vibration) at that frequency. For any given vibrational mode, the chassis may have one or more points of maximum displacement. A point of maximum displacement may be defined as the region between nodes which experiences the maximum displacement. For example a portion of the chassis ring may include two nodes and one point of maximum displacement located between the nodes. The vibrational mode may be an "odd" mode. The vibrational mode may be an "even" mode. One or more of the mass damping elements may be attached to the chassis in the region of a point of maximum displacement (and remote from any nodes). Each mass damping element may be attached to the chassis at a point of maximum displacement. The nodes of a vibrational mode may be located at the point where the support legs meet the chassis ring. A point of maximum displacement may be located midway between the nodes. Thus, a point of maximum displacement may be located midway between two support legs. Each mass damping element may be located on the chassis ring midway between two support legs. Each mass damping element may be attached to the chassis ring midway between two support legs. One or more mass damping elements may be attached directly to one or more such support legs. In a case where the legs themselves each have a vibrational mode which it would be desirable to dampen, the or each mass damping element may be attached to the support leg at or directly adjacent to the point/region of maximum displacement (typically halfway down the leg).

The chassis may be a metal chassis. The chassis may be a zinc chassis. The chassis may be a chassis comprising mostly aluminium. The chassis may be made from an aluminium alloy, for example a British Standard LM1 alloy. The chassis may be made from a metal matrix composite for example having an Aluminium matrix. The chassis preferably has a stiffness sufficiently high to cause the break-up frequencies of the chassis to be relatively high. This in turn may reduce the number of vibrational modes of the chassis that need to be dampened. The specific modulus (Young's modulus over density) of the material from which the primary chassis structure is made is preferably higher than $20\times10^6$ $m^2s^{-2}$ and preferably about $25\times10^6$ $m^2s^{-2}$ or more.

According to a second aspect of the invention there is provided a loudspeaker drive unit comprising a chassis assembly in accordance with the first aspect of the invention. The drive unit may further comprise a diaphragm. The drive unit may further comprise a motor system. The motor system may comprise a voice coil. The motor system may further comprise a driver magnet. The voice coil may be attached to the diaphragm. The diaphragm may be attached to the chassis by a suspension system. The suspension system may comprise a spider. The spider may connect the centre of the diaphragm to the chassis. The suspension system may comprise a surround. The surround may connect the periphery of the diaphragm to the chassis.

The chassis may be suitable for use in a mid-range driver. The chassis may be suitable for use in a bass driver. The chassis may be suitable for use in a full range driver.

According to a third aspect of the invention there is provided a loudspeaker enclosure comprising a loudspeaker drive unit in accordance with the second aspect of the invention. The loudspeaker enclosure may comprise a loudspeaker cabinet. The loudspeaker enclosure may comprise a loudspeaker drive unit mounted within the cabinet. For example, the cabinet may define an aperture in which the drive unit, and therefore the chassis assembly, is mounted. It will be understood of course that there may be some overlap of the drive unit and/or the fixing(s) used to attach the drive unit to the cabinet with the structure defining aperture in the cabinet. For example the drive unit may have or be attached to a flange portion that attaches to the cabinet at the periphery of the aperture.

The drive unit may be decoupled from the cabinet such that the mechanical transmission of vibration from the drive unit to the cabinet is reduced. The chassis of the loudspeaker drive unit may be decoupled from the cabinet such that the mechanical transmission of vibration from the chassis to the cabinet is reduced. The chassis of the loudspeaker drive unit may be decoupled from the enclosure by means of a suspension arrangement, such as for example a suspension ring.

According to a fourth aspect of the invention there is provided a method of manufacturing a loudspeaker chassis, wherein the method includes the following steps: providing a chassis structure having only one, two or three vibrational modes at frequencies below an upper frequency limit and adding to the chassis structure one or more mass damping elements to attenuate the frequency response at and/or around at least one of the vibrational modes.

The method may also include the step of designing a chassis structure so as to have only one, two or three vibrational modes below an upper frequency limit. The step of designing a chassis structure may include providing an original chassis structure having two or more, and maybe more than three, vibrational modes. The step may further include modifying the design of an original chassis to produce a chassis with fewer vibrational modes below an upper frequency limit. The method may include changing the material of the chassis, for example to one having a higher specific modulus. The original chassis may be a zinc chassis. The method may include changing the material from zinc to aluminium. Thus, the chassis may be an aluminium chassis.

The method may include increasing the number of legs of the chassis. The method may include modifying the shape of the legs of the chassis.

Drive units are typically provided with a known technical specification quoting a frequency range of intended operation. The aforementioned upper frequency limit may be the highest frequency of intended operation of the drive unit. Such a frequency might typically be between 1 kHz and 5 kHz. The aforementioned upper frequency limit may be higher than the intended operational range of the drive unit, if there are vibrational modes of the drive unit that cause sound readily perceived by the listener. For example, aforementioned upper frequency limit may be as high as 10 KHz, or possibly as high as 20 kHz.

The original chassis may have six legs or fewer. The method may include increasing the number of legs. Thus, the chassis may have more than six legs, and preferably has nine or more legs. For example, the chassis may have twelve legs.

The original chassis may have a leg shape. The method may include changing the shape of the leg. The method may include changing the shape of the leg by increasing the cross-sectional area of the leg. The cross-sectional area of the leg may vary with respect to distance along the length of the leg. The leg may curve as it extends between the chassis ring and the chassis base. The method may include changing the shape of the leg by altering the curvature of the leg.

The method may also include making the chassis structure according to the design. Making the chassis may include casting the chassis. Making the chassis may include cutting a blank from a sheet. Making the chassis may further include forming the blank into the shape of a chassis. Forming the blank may include pressing the blank into the shape of a chassis.

Any features described with reference to one aspect of the invention are equally applicable to any other aspect of the invention, and vice versa.

DESCRIPTION OF THE DRAWINGS

Various embodiments of the invention will now be described, by way of example only, with reference to the accompanying schematic drawings of which.

DETAILED DESCRIPTION

Figure 1:
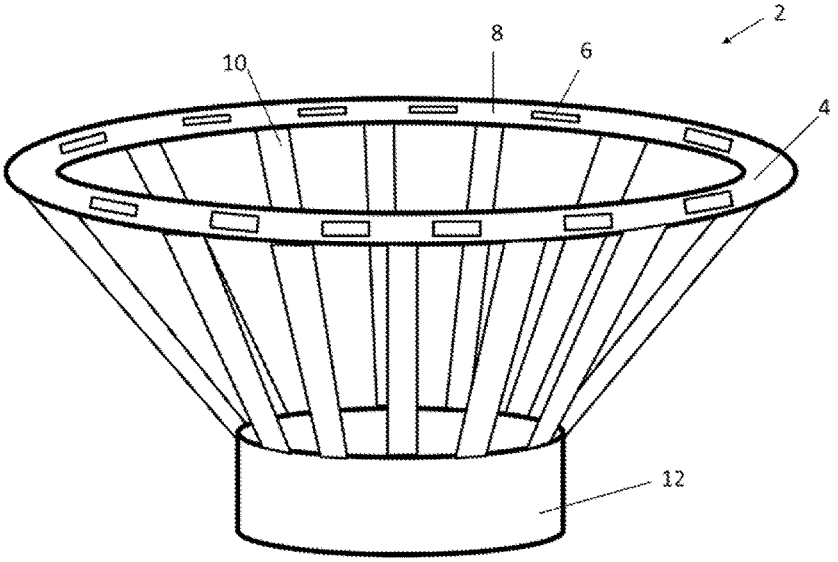
FIG. 1 is a schematic view of a chassis assembly in accordance with a first embodiment of the invention.

FIG. 1 shows a schematic view of a loudspeaker chassis assembly 2 according to a first embodiment of the invention. The loudspeaker chassis assembly 2 is configured to hold and support a loudspeaker cone and associated motor system (magnet, voice coil, etc.) to form a drive unit for use in a loudspeaker cabinet. A typical loudspeaker chassis (also known as basket) exhibits multiple mechanical resonances, like any other mechanical system, because of its mass and finite stiffness. Those mechanical resonances, also known as break-up modes, are excited during operation of the drive unit and can be detrimental if they cause the chassis to radiate unwanted sound and/or transmit unwanted vibration into the cabinet.

The drive unit incorporating the loudspeaker chassis assembly 2 of the first embodiment is configured for installation in a cabinet such that the drive unit is decoupled from the cabinet in order to reduce the mechanical transmission of vibration from the drive unit to the cabinet. The chassis is thus no longer rigidly clamped to the cabinet and is therefore free to vibrate and radiate sound. The aim of this embodiment of the invention is thus to reduce unwanted vibration in the chassis. This is achieved, as will now be explained in further detail, by increasing the break-up mode values, limiting their number, and reducing their effect on acoustic performance of the loudspeaker.

As shown in FIG. 1 the chassis assembly 2 includes a chassis 4 and twelve mass damping elements 6. The chassis 4 includes a substantially planar chassis ring 8 from which twelve support legs 10 extend to a chassis base 12. The circumference of the ring 8 is greater than the circumference of the base 12. The chassis base 12 is concentrically located within chassis ring 8. Mass damping elements 6, denoted by rectangles in this figure (see FIG. 2 for structure of mass damping elements in detail), are circumferentially spaced around the face of the chassis ring 8. Each mass damping element 6 is attached to the face of the chassis ring 8 midway between two legs 10. In use a cone-shaped diaphragm (not shown) sits within the basket created by the chassis 4.

Figure 2:
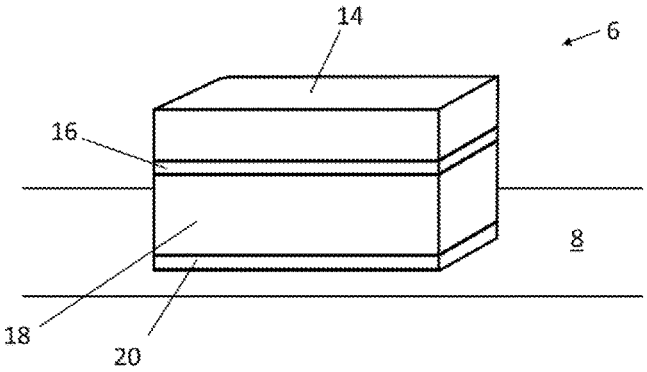
FIG. 2 is an enlarged schematic view of the mass damping element of the first embodiment.

FIG. 2 shows a schematic view of the structure of a mass damping element 6. The mass damping element is located on a portion of chassis ring 8. The mass damping element 6 is substantially cuboidal and consists of the following layers in order: a steel platelet 14, a first adhesive layer 16, a polymer block 18, and a second adhesive layer 20. The steel platelet 14 is located furthest from the chassis ring.

The second adhesive layer 20 attaches the mass damping element to the chassis ring 8. The first adhesive layer 16 attaches the steel platelet 14 to the polymer block 18. In use, the polymer block 18 transmits vibration from the chassis 4 to the steel platelet 14 via the adhesive layers 16, 20. The material of the adhesive layers 16, 20 is chosen such that these layers contribute to the damping effect of the mass damping element.

The twelve mass damping elements 6 are each in the form of a tuned mass damper (effectively equivalent to a mass on a spring) which modifies the vibrational behaviour of the chassis. The tuned mass dampers effectively replace the high amplitude resonance of a break-up mode of the chassis with two resonances of lower amplitudes.

Figure 3:
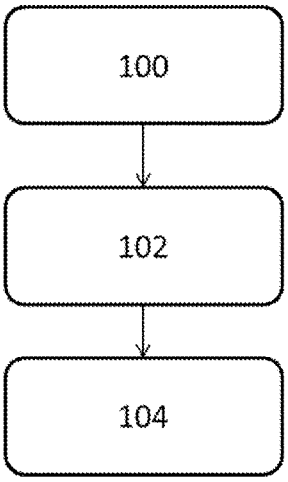
FIG. 3 is a flow chart showing the process for producing a chassis assembly in accordance with a second embodiment.

FIG. 3 shows a flow chart summarizing the processes of (re-)designing and manufacturing a chassis assembly in accordance with a second embodiment of the invention. First an original chassis design having multiple break-up modes is modified (step 100) to produce a chassis having fewer (for example only one or two) vibrational modes in the relevant frequency band. In the present example the original chassis design is a zinc chassis with six support legs having a first leg shape. The original chassis design may for example exhibit breakup modes at 2 kHz, 4 kHz, 6 kHz, and 8 kHz. Modifying (step 100) the design includes changing the design material from zinc to an aluminium alloy, modifying the leg shape and increasing the number of legs from six to twelve. Such modification may thus shift the breakup modes to higher frequencies and reduce the number of breakup modes in the audible frequency range. In this case, the breakup modes may be considered as having been shifted so that there are only two in the relevant frequency range: one at 6 kHz and one at 8 kHz.

The chassis may then be made to the improved design by casting (step 102) it from a metal material, in this case an aluminium alloy. After the casting step 102, a plurality of tuned mass damping elements are attached (step 104) to the chassis by means of an adhesive layer. The mass damping elements are all tuned to the same frequency, one that is about midway between the two breakup frequencies and therefore around 8.5 kHz. The resulting chassis assembly will exhibit suppressed breakup modes thus providing an improved acoustic performance and better frequency response.

Figure 4:
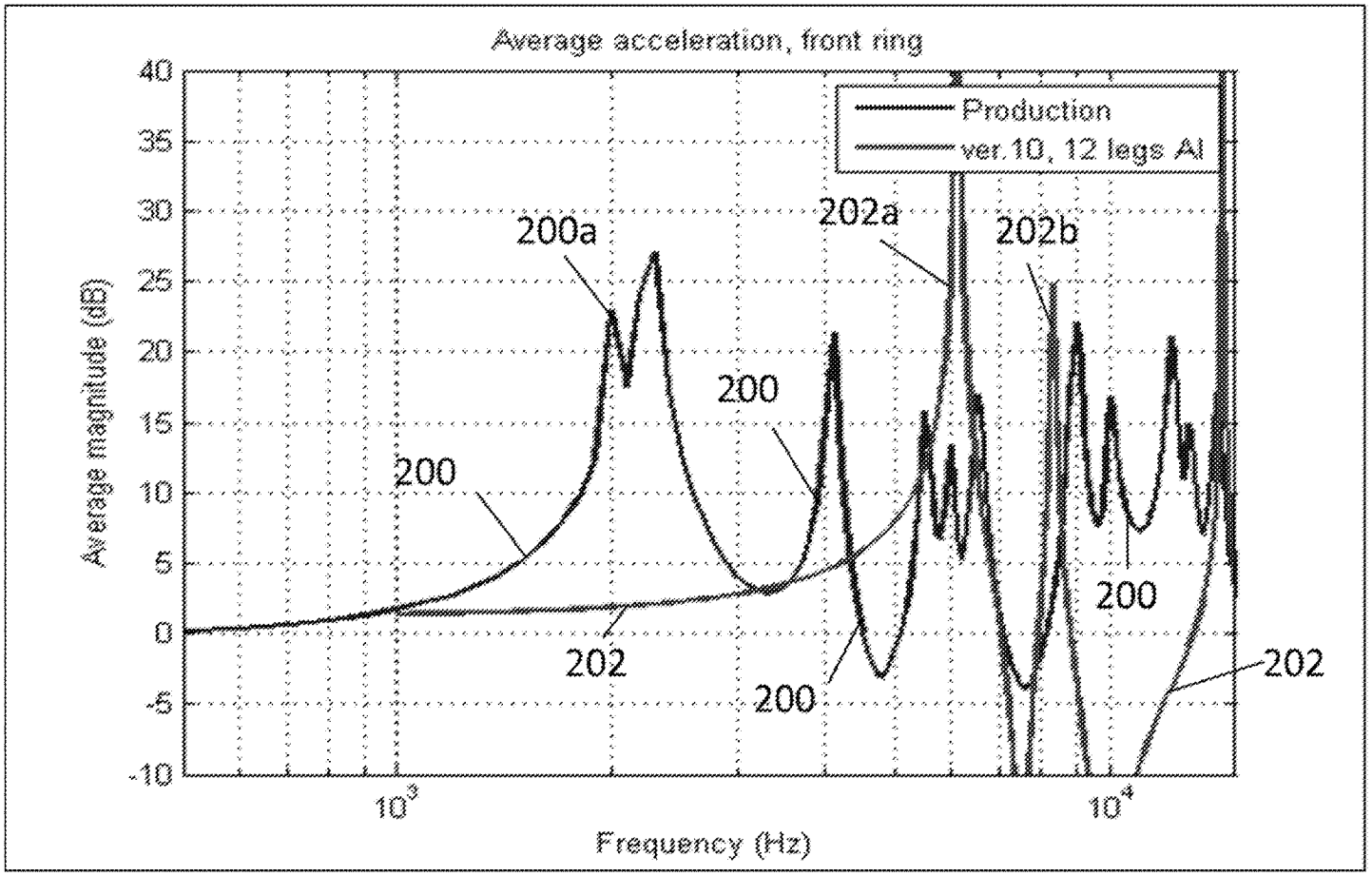
FIG. 4 is a graph comparing the acoustic response of an original chassis and a modified chassis in accordance with a third embodiment.

FIG. 4 shows the forced acoustic response in the frequency domain of an original chassis as compared to a chassis produced to a modified design in accordance with a third embodiment as predicted using the COMSOL finite element simulation package. The method used to modify the design is similar to that described in relation to the second embodiment and the resulting chassis assembly is similar to that described in relation to the first embodiment. The y-axis in FIG. 4 shows the mean acceleration of the front chassis ring and the x-axis the frequency of the input drive signal. The graph has been normalized for 0 dB amplitude at 500 Hz. Line 200 shows the response of an original chassis. Line 202 shows the response of a chassis produced to the modified design. The useful band is taken to be up to 10 kHz in this case. The original chassis experiences eight peaks in amplitude (vibrational modes) at frequencies of less than 10 kHz, the first peak 200*a* occurs at around 2 KHz. The chassis produced following modification 100 of the design has two peaks in amplitude (vibrational modes) at frequencies of less than 10 KHz. The first peak 202*a* occurs at around 6 KHz and the second peak 202*b* occurs at around 8 KHz. Thus, the number of vibrational modes of the chassis is reduced, and the modes occur at higher frequencies following modification 100.

Figure 5:
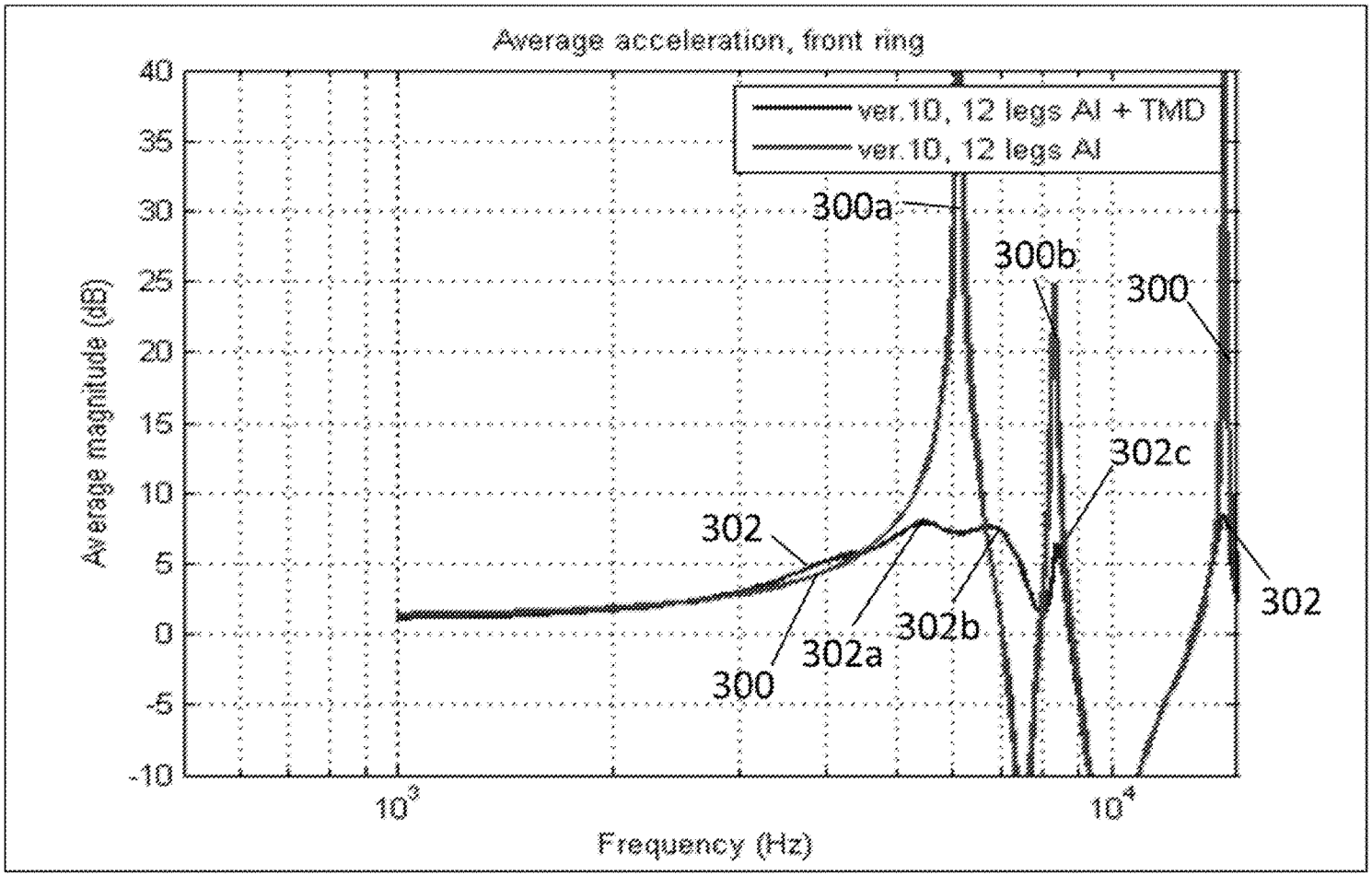
FIG. 5 is a graph comparing the acoustic response of a modified chassis in accordance with the third embodiment with and without mass damping-elements.
Figure 6:
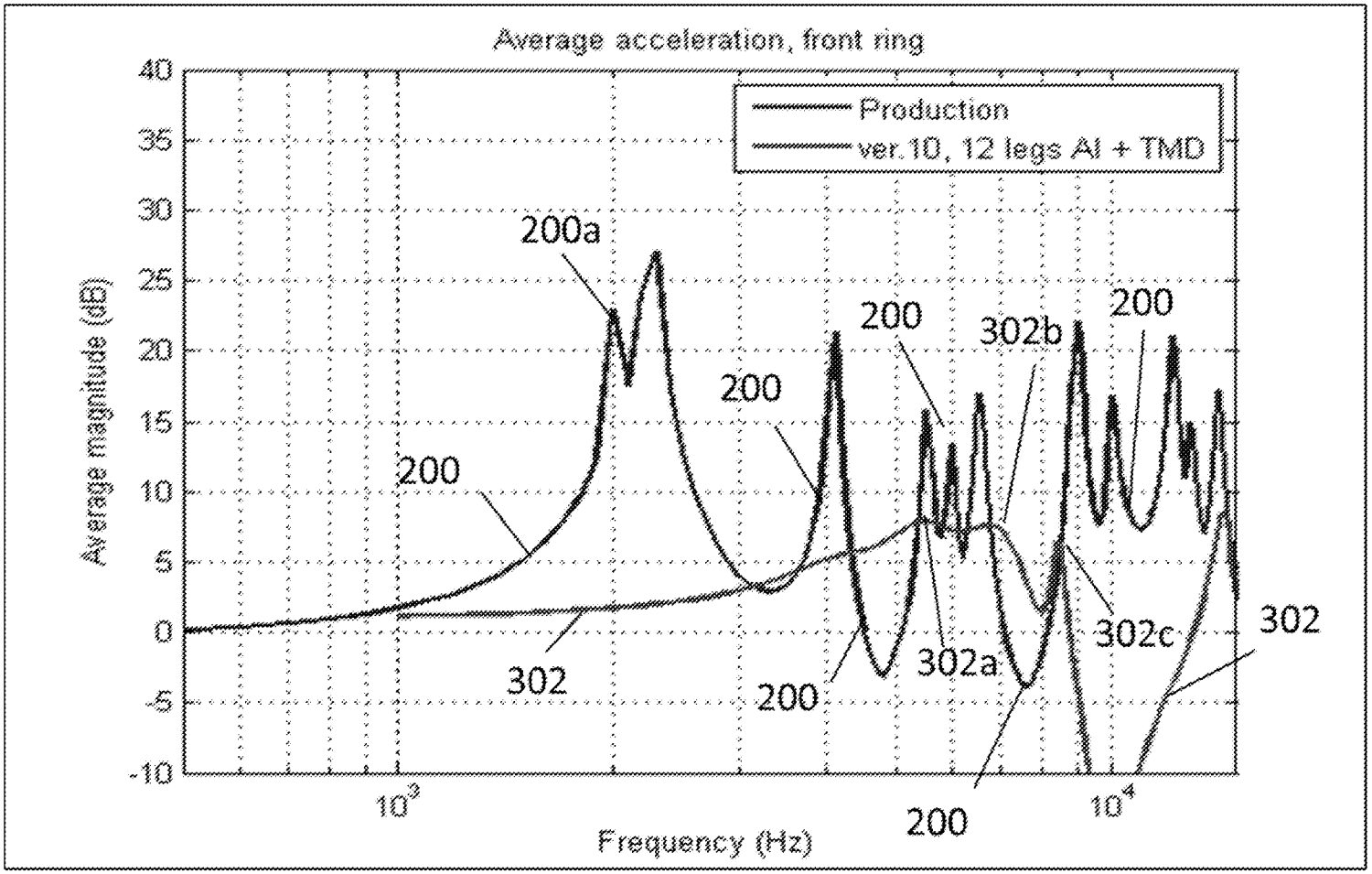
FIG. 6 is a graph comparing the acoustic response of an original chassis and a chassis assembly in accordance with the third embodiment.

FIG. 5 shows the forced acoustic response in the frequency domain of a modified chassis of the third embodiment (i.e. redesigned in material, number of legs, and provided with mass damping elements) as compared to the same modified chassis but without mass damping elements, as predicted using a finite element simulation package as described above. The y-axis shows the average acceleration of the front chassis ring and the x-axis the frequency of the input drive signal. The graph has been normalized for 0 dB amplitude at 500 Hz. Line 300 shows the response of the chassis without any mass damping elements. Line 302 shows the response of a chassis assembly including the same chassis and twelve mass damping elements located at the midway point between the nodes of vibration on the chassis ring (i.e. midway between the leg-ring junctions). Again, the frequency response of the chassis without mass damping elements has a first peak 300*a* at 6 KHz and a second peak 300*b* at 8 KHz. As shown in FIG. 6 the first peak 302*a* at 6 KHz has a significantly reduced amplitude. The amplitude of the first peak is reduced by around 40 dB as compared to the first peak 300*a* for a chassis without mass damping elements. The second peak 302*b* is also reduced compared to the second peak 302*a* for a chassis without mass damping elements. Thus, the tuned mass damping elements significantly reduce the 6 KHz mode and also attenuate vibration at other modes.

FIG. 6 compares the forced acoustic response in the frequency domain of the redesigned chassis with mass damping elements with the (6-legged) original chassis. Line 200 shows the response of the original chassis (as shown in FIG. 4) and line 302 shows the response of the redesigned chassis with mass damping elements (as shown in FIG. 5). It can be seen from FIG. 6 that the acoustic performance of the chassis assembly is significantly improved; most of the useful frequency band is free of vibration modes and the remaining modes are well damped by the tuned mass damping elements.

Figure 7:
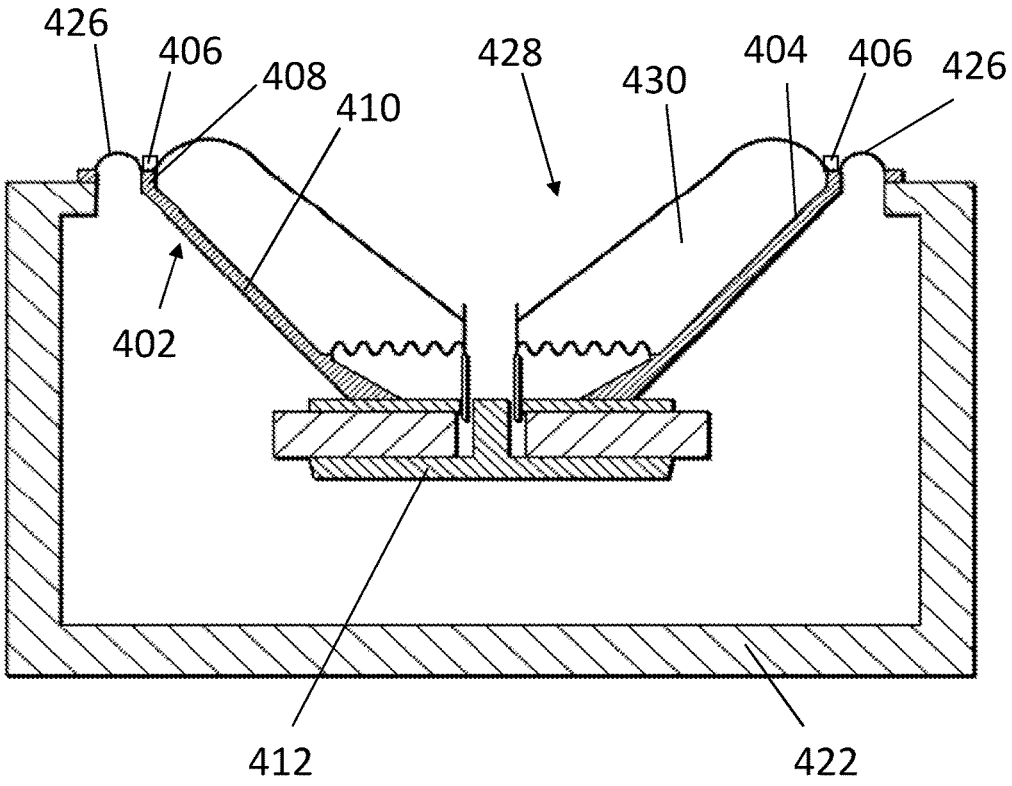
FIG. 7 is a loudspeaker enclosure including a chassis assembly in accordance with a fourth embodiment.

Above it is stated that the drive unit of the first embodiment is decoupled from the cabinet when installed in a cabinet in order to reduce the mechanical transmission of vibration from the drive unit to the cabinet. FIG. 7 shows a schematic cross-sectional view in accordance with a fourth embodiment of a loudspeaker cabinet 422 defining an aperture in which a drive unit 428 comprising a chassis assembly 402 of the first embodiment is connected. The chassis assembly 402 comprises a chassis 404, including a chassis ring 408, legs 410 and base 412, shown in cross section in this figure, and mass damping elements 406 denoted by rectangles (not to scale). A cone shaped diaphragm 430 sits within the basket created by the chassis 404. It will be seen that the chassis is connected to but decoupled from the cabinet via a gasket 426, in this case a gasket made from thermoplastic elastomer. The gasket 426 extends around the outer circumference of the chassis between the chassis ring 408 and the portion of the cabinet 422 defining the aperture. It will be understood that the issue of whether the chassis is coupled to, or decoupled from, the cabinet will be judged over a particular acoustic frequency range. The frequency range of relevance will be one that covers all frequencies likely to give rise to undesirable vibration of the chassis. The decoupling of one physical thing from another in the context of the present invention may be considered as equivalent to vibrationally decoupling the things. Thus, it will be observed that the chassis is decoupled from the cabinet but that the two objects are physically joined to each other by a means that provides the decoupling. Given that physical systems rarely behave perfectly it will also be appreciated that the decoupling of the chassis from the cabinet in accordance with this embodiment of the present invention will typically not provide perfect decoupling of the drive unit from the cabinet.

Whilst the present invention has been described and illustrated with reference to particular embodiments, it will be appreciated by those of ordinary skill in the art that the invention lends itself to many different variations not specifically illustrated herein.

The adhesive used to attach the mass damping element to the chassis and/or to attach the metal plates to the elastomeric block may be such that it contributes little, if anything, to the damping properties of the mass damping element.

The tuned mass dampers may each be formed by a single block of resilient material, such as a high hysteresis rubber pad, directly attached by means of a non-lossy glue to the chassis.

For the mass element, metal loaded plastics could be used, particularly tungsten loaded plastics as they are heavy and moldable at low temperature, leading to more design options.

The mass damping elements of the loudspeaker cabinet of the fourth embodiment of the invention show the mass damping elements attached to a forward facing surface of the chassis. The damping elements may however be attached to the front, side and/or rear of the chassis ring, or other parts of the chassis. For example, the mass damping elements may be provided on a rearward facing surface of the chassis, so that the elements may easily be hidden from view. Alternatively, or additionally, mass damping elements may be attached to the outer circumferential edge/surface of the chassis so that the elements damp vibration of the chassis by means of varying shear forces on the elements (in contrast to other embodiments of the invention in which the elements dissipate energy by compressing/uncompressing). One or more mass damping elements may be attached to the spokes of the chassis.

Where in the foregoing description, integers or elements are mentioned which have known, obvious or foreseeable equivalents, then such equivalents are herein incorporated as if individually set forth. Reference should be made to the claims for determining the true scope of the present invention, which should be construed so as to encompass any such equivalents. It will also be appreciated by the reader that integers or features of the invention that are described as preferable, advantageous, convenient or the like are optional and do not limit the scope of the independent claims.

The invention claimed is:

1. A loudspeaker enclosure, comprising:

an aperture in which a loudspeaker chassis assembly is mounted, the loudspeaker chassis assembly comprising a loudspeaker chassis and one or more mass damping elements, each mass damping element including a mass element, each mass damping element having a first end and a second end opposite the first end, the first end being mounted on the loudspeaker chassis and the second end being free to move relative to the loudspeaker chassis and the rest of the loudspeaker enclosure, and each mass damping element being configured to damp vibration of the loudspeaker chassis by dissipating energy through movement of the mass element relative to the loudspeaker chassis.

2. The loudspeaker enclosure according to claim 1, wherein the or each mass damping element includes a resilient portion.

3. The loudspeaker enclosure according to claim 2, wherein the resilient portion is an elastically deformable block.

4. The loudspeaker enclosure according to claim 1, wherein the or each mass damping element is directly attached to the loudspeaker chassis.

5. The loudspeaker enclosure according to claim 1, wherein the mass damping elements are tuned mass damping elements being so tuned to damp one or more vibrational modes of the loudspeaker chassis.

6. The loudspeaker enclosure according to claim 5, wherein all of the tuned mass damping elements are tuned to have substantially the same frequency-dependent attenuation properties.

7. The loudspeaker enclosure according to claim 1, wherein the one or more mass damping elements comprise a metal loaded plastic material.

8. The loudspeaker enclosure according to claim 1, wherein the loudspeaker chassis comprises a chassis ring and the one or more mass damping elements are attached to the ring.

9. The loudspeaker enclosure according to claim 8, including a plurality of mass damping elements circumferentially spaced around the chassis ring.

10. The loudspeaker enclosure according to claim 8, wherein the loudspeaker chassis includes at least nine support legs extending from the chassis ring.

11. The loudspeaker enclosure according to claim 10, wherein each mass damping element is located on the chassis ring midway between two adjacent support legs.

12. The loudspeaker enclosure according to claim 1, wherein the loudspeaker chassis comprises a metal chassis.

13. A loudspeaker drive unit, comprising the loudspeaker chassis assembly as claimed in claim 1.

14. The loudspeaker enclosure according to claim 1, wherein the enclosure comprises a loudspeaker drive unit, the loudspeaker chassis assembly forming part of the loudspeaker drive unit.

15. The loudspeaker enclosure according to claim 14, wherein the enclosure comprises a cabinet defining the aperture in which the loudspeaker chassis assembly is mounted and wherein the loudspeaker chassis is decoupled from the cabinet by a suspension arrangement.

16. The loudspeaker enclosure according to claim 1, wherein the mass element of the mass damping element is a metal plate.

17. A loudspeaker chassis assembly configured for use as a loudspeaker chassis assembly, the loudspeaker chassis assembly comprising a loudspeaker chassis and one or more mass damping elements, each mass damping element including a mass element, each mass damping element having a first end and a second end opposite the first end, the first end being mounted on the loudspeaker chassis and the second end being free to move relative to the loudspeaker chassis and the rest of the loudspeaker enclosure, and each mass damping element being configured to damp vibration of the loudspeaker chassis by dissipating energy through movement of the mass element relative to the loudspeaker chassis.

18. A loudspeaker enclosure, comprising:

a loudspeaker drive unit, the loudspeaker drive unit comprising a loudspeaker chassis assembly, the loudspeaker chassis assembly comprising:

a loudspeaker chassis and one or more mass damping elements, each mass damping element including a mass element, each mass damping element having a first end and a second end opposite the first end, the first end being mounted on the loudspeaker chassis and the second end being free to move relative to the loudspeaker chassis and the rest of the loudspeaker enclosure, wherein said one or more mass damping elements are configured to damp vibration of the loudspeaker chassis by dissipating energy through movement of the mass element relative to the loudspeaker chassis, and the loudspeaker enclosure being arranged such that the loudspeaker chassis assembly is decoupled from the loudspeaker enclosure.

19. A loudspeaker enclosure comprising:

an aperture in which a loudspeaker chassis assembly is mounted, the loudspeaker chassis assembly comprising a loudspeaker chassis and a plurality of discrete and spaced apart mass damping elements for damping vibration of the chassis, and each mass damping element having a first end and a second end opposite the first end, the first end being mounted on the loudspeaker chassis and the second end being free to move relative to the loudspeaker chassis and the rest of the loudspeaker enclosure.

20. The loudspeaker enclosure according to claim 19, wherein each mass damping element includes a mass element and a resilient portion.

21. The loudspeaker enclosure according to claim 19, wherein the loudspeaker chassis comprises a chassis ring and the mass damping elements are circumferentially spaced around the chassis ring.

22. The loudspeaker enclosure according to claim 19, wherein the loudspeaker chassis comprises a chassis ring and a plurality of support legs extending from the chassis ring, and each mass damping element is located on the chassis ring midway between two adjacent support legs.

* * * * *